US005338277A

United States Patent [19]

Yang

[11] Patent Number: 5,338,277

[45] Date of Patent: Aug. 16, 1994

[54] BODY BUILDING APPARATUS WITH A NECK MASSAGER

[76] Inventor: Li H. Yang, No. 11, Alley 1, Lane 78, Changhua, Taiwan

[21] Appl. No.: 62,811

[22] Filed: May 11, 1993

[51] Int. Cl.[5] ..... A63B 21/055

[52] U.S. Cl. ..... 482/130; 482/52; 482/137

[58] Field of Search ..... 402/51-53, 402/100, 121-132, 138, 137

[56] References Cited

U.S. PATENT DOCUMENTS

| | | | |
|---|---|---|---|
| 3,861,382 | 1/1975 | Simjian | 482/132 X |
| 4,193,394 | 3/1980 | Everett et al. | 482/132 X |
| 4,226,415 | 10/1980 | Wright | 482/137 X |
| 4,411,421 | 10/1983 | Hershberger | 482/132 X |
| 4,618,144 | 10/1986 | Gibson | 482/138 |
| 4,666,149 | 5/1987 | Olschansky et al. | 482/130 |
| 4,666,152 | 5/1987 | Jones | 482/137 |
| 4,709,923 | 12/1987 | Gibson | 482/138 |
| 4,711,448 | 12/1987 | Minkols et al. | 482/137 X |
| 4,763,897 | 8/1988 | Yakata | 482/137 X |
| 4,809,976 | 3/1989 | Berger | 482/130 |

OTHER PUBLICATIONS

The Apex Circuit Trainer, 1992.

The Owner's Manual For The "Weider Flex CTS Cross Training System," Mar. 1990.

*Primary Examiner*—Robert Bahr

*Attorney, Agent, or Firm*—Merchant, Gould, Smith, Edell, Welter & Schmidt

[57] ABSTRACT

A body building apparatus with a neck massager including a rocker arm pivotally fastened to a bridge-like base frame, and two vertical pedals bilaterally disposed at one end, the rocker arm having a horizontal handle at the top end covered with a cylindrical member with raised portions, whereby a user sits on a seat to exercise the arms by pushing or pulling the handle downwards and upwards alternately; and alternatively, the user may sit on the seat with the back of the neck biased against the cylindrical member to exercise the legs and the trunk by stepping on the pedals and bending the trunk downwards and upwards alternately while allowing the back of the neck to be rubbed by the raised portions of the cylindrical member.

2 Claims, 3 Drawing Sheets

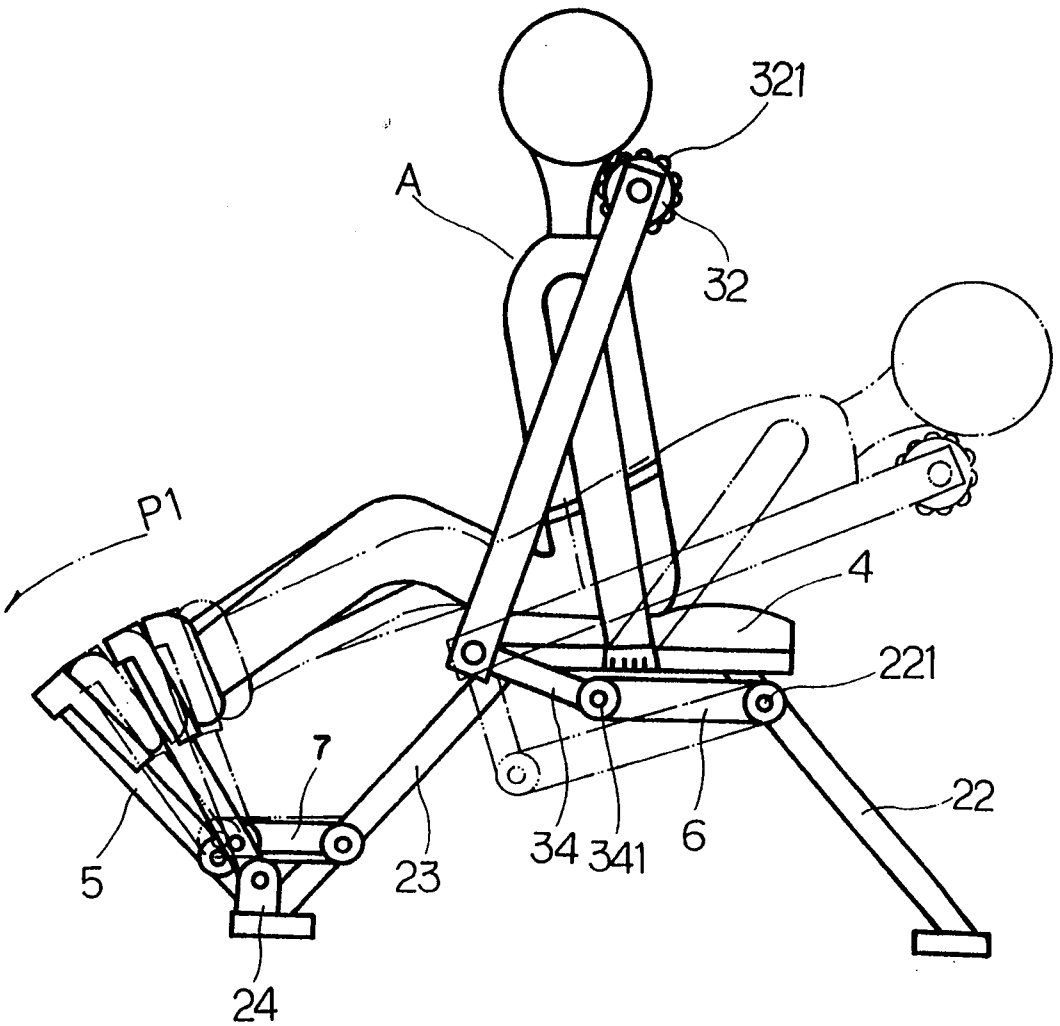
FIG. 2-A

BODY BUILDING APPARATUS WITH A NECK MASSAGER

BACKGROUND OF THE INVENTION

The present invention relates to a body building apparatus with a neck massager which can be alternatively used to develop the muscles of the hands or to exercise the legs and the trunk. A cylindrical member is moved to rub the back of the neck as the user operates the apparatus to exercise the legs and trunk.

It has been known that the muscles and joints must be regularly and properly exercised. Various exercise apparatus have been disclosed for body exercising indoors, and have appeared on the market. These exercise apparatus may be designed for a specific function for multiple purposes. However, conventional multi-purpose exercise apparatus are commonly heavy and expensive. Further, conventional exercise apparatus do not include structure to massage the back of the head and the neck while one is exercising.

SUMMARY OF THE INVENTION

According to one aspect of the present invention, the body building apparatus comprises a rocker arm pivotally fastened to a bridge-like base frame thereof at the top, and two vertical pedals bilaterally disposed at one end of the base frame. The rocker arm has a horizontal handle at an upper free end covered with a cylindrical member with raised portions, an opposite end of the rocker arm pivotally connected to a back stand of the base frame and connected to a front stand of the base frame by an elastic link. Each pedal is connected to the back stand by a respective elastic link. The user may sit on a seat mounted on the base frame and exercise the arms by pulling the handle and thus the free end of the rocker arm, downwards and upwards alternately. Alternatively, the user may sit on the seat with the back of the user's neck biased against the cylindrical member to exercise the legs and the trunk by stepping on the pedals and bending the trunk downwards and upwards alternately while allowing the back of the neck to be rubbed by the raised portions of the cylindrical member.

According to another aspect of the present invention, the seat is disposed at such an elevation that the lower part of the leg is smoothly disposed in vertical with the foot supported on the ground as the user sits on the seat.

According to still another aspect of the present invention, each pedal has a top end covered with a rubber cushion which has transverse ribs for positive contact with the user's feet.

According to still another aspect of the present invention, additional elastic links can be added to increase the resisting force as desired.

According to still another aspect of the present invention, the elastic member can be made of any material or include any device which is capable of returning to its former shape after being stretched.

BRIEF DESCRIPTION OF THE PREFERRED EMBODIMENT

FIG. 2A illustrates the rocker arm of the preferred embodiment moved backwards and downwards with the trunk while the pedals are moved forward and downwards with the legs.

DETAILED DESCRIPTION OF THE PREFERRED EMBODIMENT

Figure 1:
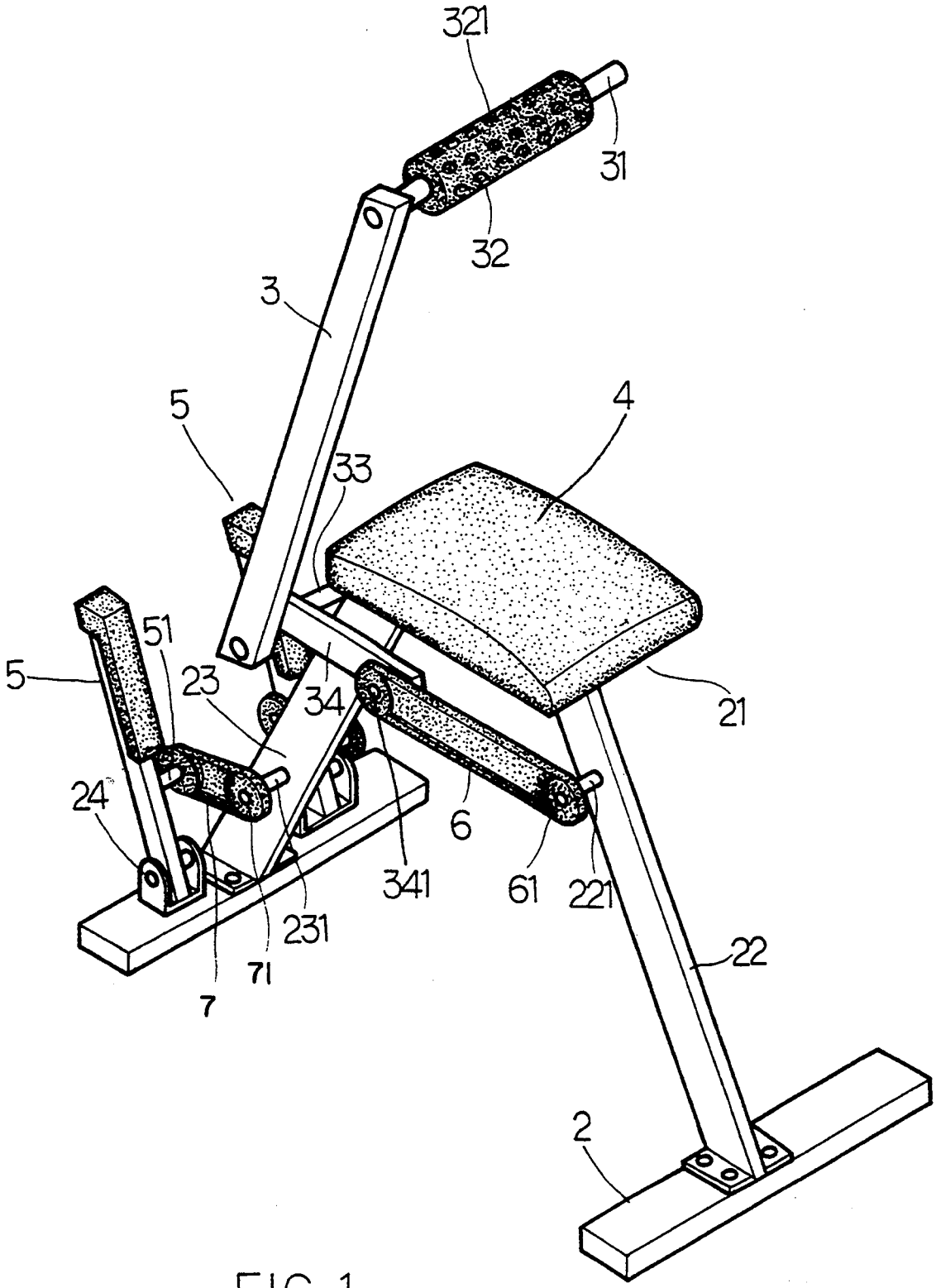
FIG. 1 is a perspective view of a body building apparatus according to the preferred embodiment of the present invention.

Referring to FIG. 1, a body building apparatus in accordance with the preferred embodiment of the present invention is generally comprised of a base frame 2, a rocker arm 3, a seat 4, a pair of pedals 5, and a plurality of elastic links 6,7. The base frame 2 is made in the shape of a bridge, comprising a horizontal top member 21 supported between a front stand 22 and a back stand 23 at the top. A horizontal projecting rod 221 is projected from one side of the front stand 22. The back stand 23 comprises two horizontal projecting rods 231 bilaterally aligned in the middle of the stand, and two pivot holders 24 vertically disposed at two opposite locations on the foot of the back stand 23. The seat 4 is mounted on the top member 21 of the base frame 2 for the user to sit thereon comfortably. The rocker arm 3 has an upper free end which includes a handle 31 mounted at a right angle thereto, and an opposite end of the rocker arm 3 is connected to a mounting rod 33 at a right angle thereto. The handle 31 is covered with a cylindrical member 32 which has raised portions 321 formed around the outside surface. The mounting rod 33 is revolvably and horizontally fastened to the back stand 23 of the base frame 2 near the top member 21. A connecting rod 34 is connected at one end to the rocker arm 3 at a right angle thereto above the mounting rod 33. A projecting rod 341 is formed on the free end of the connecting rod 34 spaced from the rocker arm 3. The projecting rod 341 of the connecting rod 34 is connected to the projecting rod 221 on the front stand 22 by an elastic link 6. The pedals 5 are respectively and pivotally connected to the pivot holders 24 at one end, each pedal 5 having a horizontal projecting rod 51 formed midway along its length at an inner side of the pedal. The horizontal projecting rod 51 of each pedal 5 is connected to a corresponding projecting rod 231 formed on the back stand 23 by a respective elastic link 7. The elastic links 6,7 are made from an elastic material in a narrow, elongated shape, having two mounting holes 61,71 on opposite ends thereof for inserting onto respective projecting rods.

Figure 2:
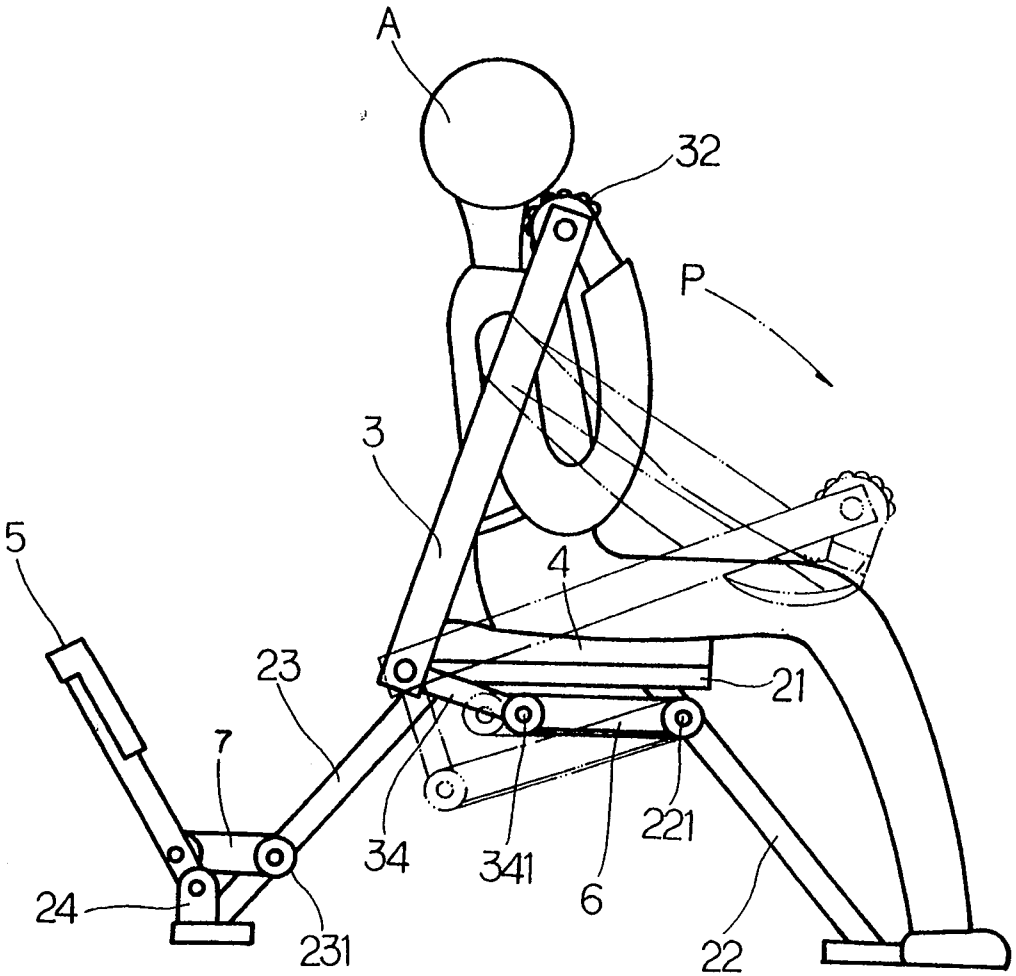
FIG. 2 illustrates the rocker arm of the preferred embodiment moved downwards with the hands to stretch the elastic link connected between the rocker arm and the front stand.

Referring to FIGS. 2 and 2A, the apparatus can be alternatively operated in either way to develop the muscles of the hands and arms (see FIG. 2), or the muscles of the abdomen and the legs (see FIG. 2A). As illustrated in FIG. 2, the user A sits on the seat 4 to hold the handle 31 with the hands for permitting the cylindrical member 32 to stop below the user's lower jaw, then alternately pushes or pulls the rocker arm 3 downwards (in the direction P) and upwards to stretch the elastic link 6 between the mounting rod 34 and the front stand 22. As illustrated in FIG. 2A, the user A sits on the seat 4 with the feet placed on the pedals 5 and the back of the neck biased against the cylindrical member 32, then presses the legs in the direction P1 while the trunk is bending backwards and downwards. While bending the trunk backwards and downwards, the back of the neck is massaged by the raised portions 321 of the cylindrical member 32.

What is claimed is:

1. A body building apparatus comprising a base frame having a seat supported between a front stand and a back stand at the top; two pedals, each having a bottom end pivotally connected to a pivot holder on a base of said back stand and a middle part thereof connected to said back stand by an elastic link; a rocker arm having a top end connected with a handle at a right angle thereto, and a bottom end connected with a mounting rod at a right angle thereto, said handle being covered with a cylindrical member, said cylindrical member having raised portions formed over the outside surfacer thereof for massaging said mounting rod being revolvably connected to said back stand; and a connecting rod having one end fixed to said rocker arm at a right angle thereto and an opposite end connected to said front stand by an elastic member.

2. The body building apparatus according to claim 1 wherein each pedal has a top end covered with a rubber cushion, said rubber cushion having transverse ribs formed thereon for positive contact with a user's feet.

* * * * *